United States Patent [19]

Spieldiener et al.

[11] Patent Number: 4,576,373

[45] Date of Patent: Mar. 18, 1986

[54] AERIAL AMUSEMENT RIDE

[76] Inventors: Robert Spieldiener, Im Winkel #13, FL 9496 Balziers, Liechtenstein; Alfons Saiko, Speerstrasse 26 A, 8942 Oberrieden; Reinhold Spieldiener, Aussichtssrasse 23, 8704 Herrliberg, both of Switzerland

[21] Appl. No.: 544,634

[22] Filed: Oct. 24, 1983

[51] Int. Cl.[4] ..... A63G 1/28

[52] U.S. Cl. ..... 272/41

[58] Field of Search ..... 272/40, 41, 42, 29, 272/6, 7, 31 A, 31 B; 434/30, 35, 55, 56, 57

[56] References Cited

U.S. PATENT DOCUMENTS

| | | | |
|---|---|---|---|
| 951,061 | 3/1910 | Easton et al. | 272/41 |
| 2,304,341 | 12/1942 | Dennis | 272/41 |
| 2,364,699 | 12/1944 | Eastman | 272/41 |
| 3,375,669 | 4/1968 | Garcia | 272/41 X |

FOREIGN PATENT DOCUMENTS

| | | | |
|---|---|---|---|
| 448715 | 9/1921 | Fed. Rep. of Germany | 272/40 |
| 344687 | 11/1921 | Fed. Rep. of Germany | 272/41 |
| 425860 | 4/1911 | France | 272/40 |
| 802197 | 6/1936 | France | 272/40 |
| 404168 | 6/1966 | Switzerland | 272/7 UX |
| 188485 | 11/1922 | United Kingdom | 272/40 |

*Primary Examiner*—Robert A. Hafer
*Assistant Examiner*—Arnold W. Kramer
*Attorney, Agent, or Firm*—Bielen & Peterson

[57] ABSTRACT

An aerial amusement ride for simulating the flight of an air craft having a central tower with an outrigger structure from which a plurality of aircraft vehicles are suspended on cables and rotated about the axis of the tower, the ride including apparatus for raising and lowering the outrigger structure on the tower and reeling the cables in and out while the vehicles are being rotated about the tower to simulate a takeoff and landing.

12 Claims, 6 Drawing Figures

AERIAL AMUSEMENT RIDE

BACKGROUND OF THE INVENTION

This invention relates to an amusement ride and in particular an aerial ride that simulates the experience of a vintage open cockpit airplane.

In prior art devices a plurality of airplanes have been suspended from a star outrigger structure connected to a ring that travels up and down a central support tower. Each airplane was connected to a cable that was guided around a pulley at the distal end of an outrigger member, around a pulley at the base of the outrigger member and up alongside the tower to the tower top. From there the cable was guided over a set of pulleys and down into the interior of the tower. There the ends of the cables from the several airplanes were connected to a piston in a hydraulic cylinder, which on retraction would pull the cables hoisting the airplanes up short distance. The star outrigger structure was raised to a top position and mechanically locked before the entire tower and connected outrigger structure was rotated to effect a simulated flying. After the ride, the rotation was halted before the cables were reeled in, the outrigger structure lowered to the ground position, and the airplanes lowered the final distance to the ground for completion of the cycle.

The disadvantages in this prior art device relate to capacity, safety and the quality of the ride.

Raising the star outrigger structure and airplanes to an operating position before commencing rotation, and lowering the outrigger structure after the ride required substantial time. This resulted in a very restricted program and consequently limited capacity, which was well below 700 riders per hour.

The prior art cable design with the cables tracking over the outrigger members directed virtually all of static and dynamic loads of the airplane and passengers on the structure of the outrigger members and the tracked cable. Failure of either the outrigger member or the loaded cables would have disasterous consequences.

Finally, the effect generated by raising the outrigger structure and airplanes to a start position before commencing rotation and flying detracted from the fantasy of flying in a vintage airplane that is an object of the ride.

These disadvantages have been overcome by the novel construction and operation of the aerial amusement ride of this invention. By constructing a device that permits rotation and flying as an outrigger structure is raised to a maximum height and as it is lowered allows the ride to begin immediately and continue through decent, thereby substantially increasing hourly capacity for a given ride duration.

Design of a cable tracking system that is braced rather than supported by the outrigger structure relieves substantial loads from the outrigger structure. Further use of a two cable system for each airplane supported by consecutive outrigger members and controlled by separate winches divides loads and thereby maximizes safety.

Using an independently controlled two cable system connected fore and aft to a plane, and rotating the outrigger as the ourtigger and planes are raised, provides a substantial capability to simulate a takeoff and a landing. By independently controlling the cables the plane's nose can be raised and lowered, respectively, on takeoff and landing. This control provides a more natural experience for the rider.

The primary object of the substantial improvements to the aerial ride is to increase the user capacity while at the same time to provide a safer, more exciting ride.

SUMMARY OF THE INVENTION

The aerial amusement ride of this invention is constructed and operated to simulate the flying of a vintage open cockpit airplane. The mechanical apparatus comprising the invention, however, can be utilized for any vehicle such as a spaceship, hang glider or other imaginative passenger container, and is therefore not restricted to the particular vintage biplane used in the preferred embodiments to describe the apparatus. Certain select features are described for use in a smaller aerial ride as an alternate embodiment to provide an understanding of the scope of this invention.

It is a primary object of this invention to provide a high capacity amusement ride that simulates a takeoff and landing of a flying machine with a nose up climb to maximum altitude, a variable ride cruise at maximum speed, and a nose down decent to a simulated landing.

To accomplish this manoeverability the vehicles are supported fore and aft by separate cables which are indepently controlled by separate winches. The cables are guided through pulleys at the distal ends of outrigger members of a multiple member outrigger structure. The outrigger structure has an inner ring which is raised and lowered on a central tower as the outrigger structure is rotated independent of a stationary tower, or with a rotating tower in an alternate embodiment.

Reeling in or letting out the cables as the outrigger structure rotates provides variations in the flight pattern such as a high flight close to the outrigger structure or a low sweeping flight closer to the ground. By independently controlling the winching of the fore and aft cable, a nose up or nose down effect can be provided to simulate climbing or decent.

The winches and height of the outrigger are controlled electrically by a microprocessor to program the desired flight pattern and ride duration desired by the operator. Further, the rotation of the outrigger is controlled by the processor to program a smooth gradual speeding during takeoff to cruise and a gradual slowing during descent and landing. Because the ride simulates the various phases of actual flight it begins immediately after the vehicles are lifted up a short distance from the ground to clear takeoff. In this manner a high capacity amusement ride, up to 1300 passengers per hour, is provided.

These and other features are described in greater detail in the detailed description of the preferred embodiments.

DETAILED DESCRIPTION OF THE PREFERRED EMBODIMENTS

Figure 1:
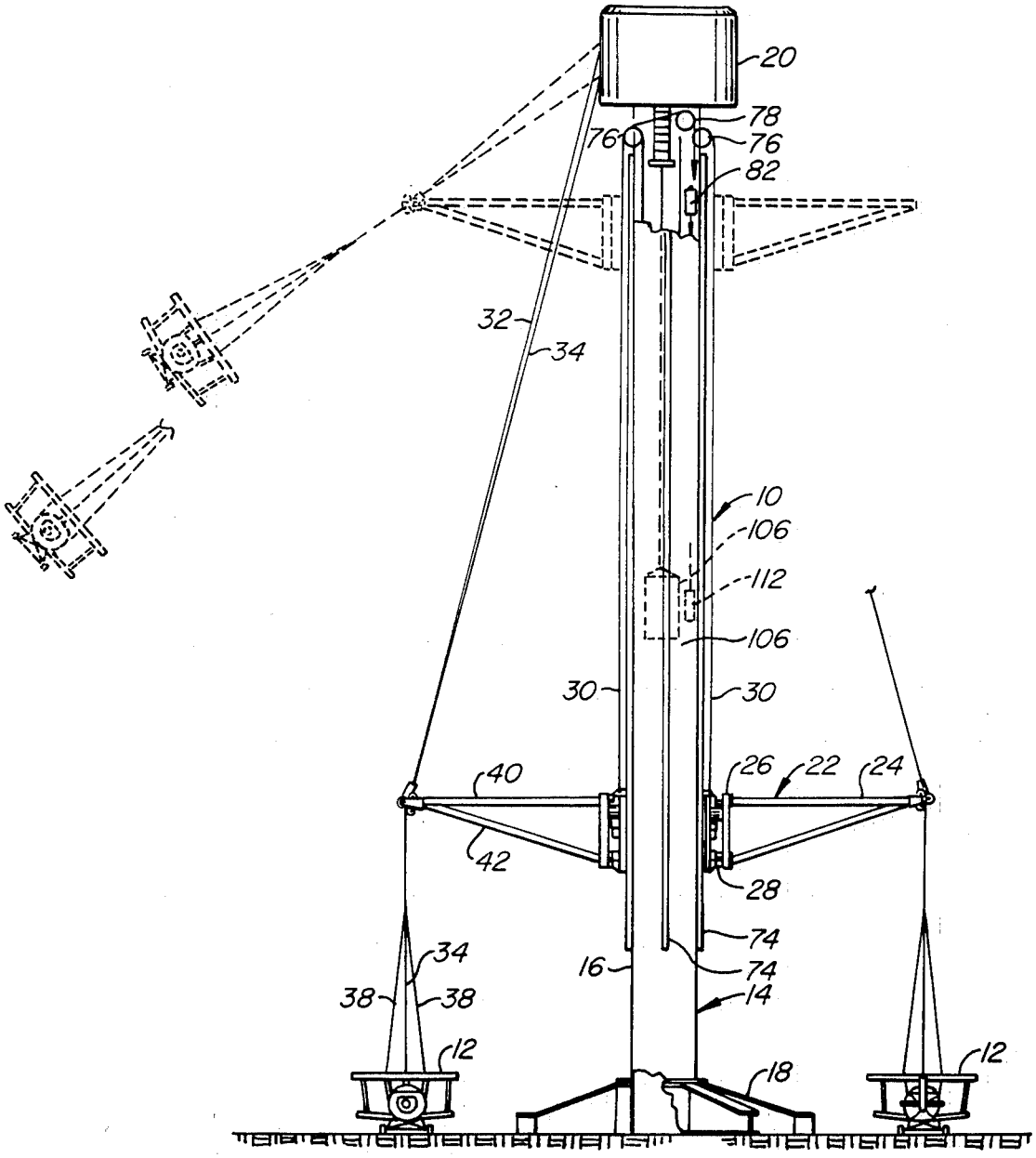
FIG. 1 is a front view partially fragmented of the aerial amusement ride.
Figure 3:
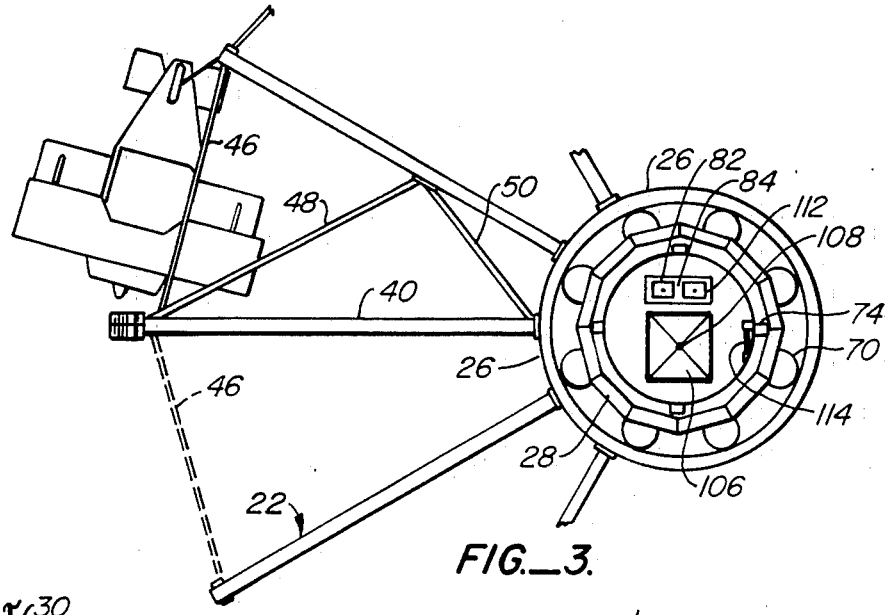
FIG. 3 is a cross sectional view partially fragmented of the ride of FIG. 1.

Referring to FIG. 1, the amusement ride of this invention, designated generally by the reference numeral 10 is shown in its primary embodiment in an elevational view with vintage biplanes 12 as the ride vehicle. The particular vehicle configuration is not important, but it should be of a type that is compatible with the aerial theme of the ride.

The amusement ride is constructed with a central tower 14 of selected height, for example, 120 feet. The tower 14 has a central hollow column 16 which is set in concrete, or, as shown, inserted in a structural steel star footing 18 bolted to a suitable ground surface. The column 16 raises to a top machine room 20, which rotates about the stationary column 16. Concentrically arranged on the column 16 is a star outrigger structure 22 having in this embodiment twelve outrigger members 24 projecting from a central hub 26. The hub is rotably connected to a ring unit 28 which is supported by hoist cables 30 for raising or lowering the ring unit 28 and engaged outrigger structure 22 during operation of the ride.

Figure 5:
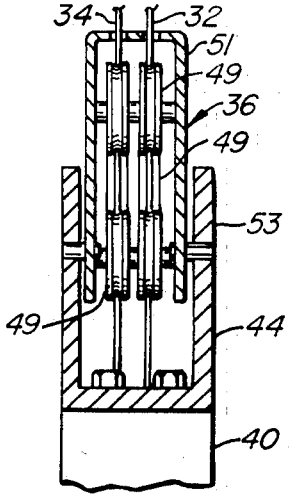
FIG. 5 is a cross sectional view taken on the lines 5—5 in FIG. 2.

The biplanes 12 are supported from the machine room 20 at the top of the tower 14 by a pair of cables 32 and 34 which pass through pulley units 36 pivotally mounted at the distal ends of adjacent outrigger members 24, and connect, respectively, to the fore and aft of a biplane 12. The fore cable 32 is bifurcated into two cable segments 38 to provide a three point connection to the biplane for stability. Each outrigger member 24 thereby provided a brace for a cable supporting the aft portion of one biplane and the fore portion of the next adjacent biplane using the double-gang pulley unit 36 as shown in FIGS. 1, 2 and 5.

Figure 2:
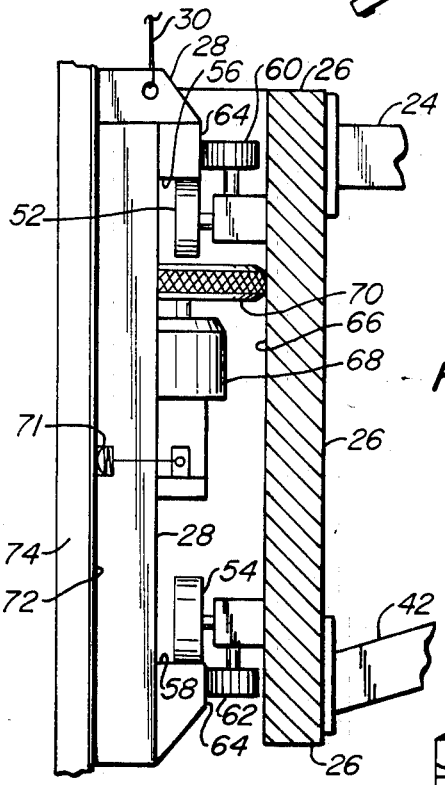
FIG. 2 is an enlarged cross sectional view of a portion of the outrigger and tower.
Figure 2:
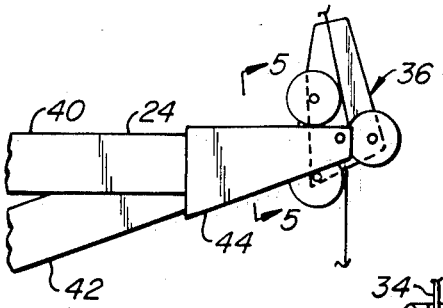

Referring to FIGS. 1 and 2 the star outrigger structure 22 is constructed with a boom member 40 connected to the top rim of the central hub 26 and vertically braced by a brace member 42 connected to the distal end 44 of the boom member 40 and to the bottom rim of the hub 26. Adjacent boom members are structurally interconnected by horizontal cord members 46 and braced by a pair of interconnecting brace elements 48 and 50.

The end 44 of the boom member 40 is bifurcated to pivotally receive the pulley unit 36. The pulley unit 36 comprises three sets of tandum pulleys 49 rotably mounted in a shell 51, which is connected to the boom end 44 by pivot pins 53.

As shown in the cross sectional view of FIG. 2, the central hub 26 has a series of upper rollers 52 and lower rollers 54 engaging, respectively, a stationary upper track rim 56 and a lower track rim 58. The track rims are an integral part of the inner ring unit 28, and form the bearing support for the outrigger structure to rotate about the tower. Concentricity is maintained by a series of upper rollers 60 and lower rollers 62 which engage the outer face 64 of the upper and lower track rims, 56 and 58. Rotating electrical drive units 68 mounted on the ring units 28 have friction drive wheels 70 which engage the inside face 66 of the hub 26. The drive units 68 rotate the hub and outrigger structure according to signals received from the machine room via contacts 71 which engage slide conductors 72 on the edge of vertical guides 74.

The guides 74, as shown in FIGS. 1, run substantially the length of the tower 14 and permit the ring unit to be raised or lowered by the hoist cables 30 while providing a rotationally stationary bearing structure for the rotatable outrigger structure.

Figure 4:
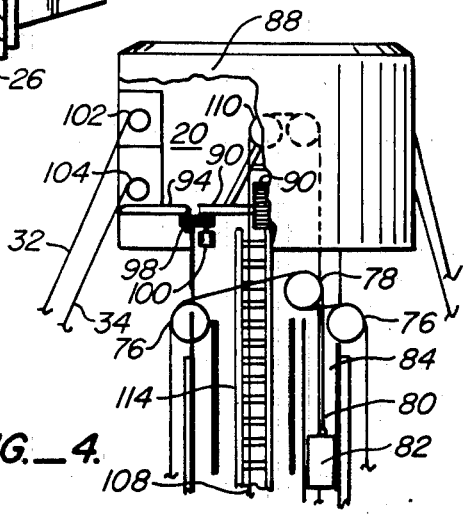
FIG. 4 is an enlarged cross sectional view partially fragmented of the machine room and tower.

The two hoist cables 30, connected to the ring unit 28, are disposed alongside the tower column 16, passed over guide pulleys 76 mounted proximate the top of the column and wrapped around a hoist winch 78 shown in FIG. 4. The hoist winch 78 includes a cable 80 connected to a counterweight 82 which is contained in a central guide shaft 84. As illustrated in FIG. 1 the hoist winch 78 raises the outrigger structure from the low position shown to the high position shown in phantom, or any position therebetween as programmed.

Referring to FIG. 4, the machine room 20 is constructed with a rotating outer housing 88 on a central stationary core 90 on which is positioned a slip ring junction box 92 for transferring electrical power and control signals from the stationary core to the rotating components. The housing 88 is connected to a base disc 94 having a bearing mechanism 98 at the top of the tower column 16.

An electrical drive 100, mounted to the stationary column 16 drives the base disc 94 and housing in coordination with the drive units 68 on the outrigger structure 22 such that the machine room 20 and the outrigger structure 22 rotate in unison.

Mounted in the rotating machine room 20 are twenty four winches, 102 and 104, which are mounted in pairs in alignment with the twelve outrigger boom members 40 of the outrigger structure. The upper winches 102 control cables 32 connected to the fore portion of the biplane, and the lower winches 104 control cables 34 connected to the aft portion of the biplanes. The two banks of winches are independently controlled to enable the nose up or nose down flight simulation to be performed in accordance with the preset flight program controlled by a microprocessor (not shown).

Access to the machine room is by either an elevator 106, with cable 108, winch 110 and counter weight 112, and emergency side ladder 114, or, an internal stairway (not shown). Operation and control of the amusement ride is performed from a conveniently located control station at the base of the tower or displaced therefrom. While the operation is controlled by a microporcessor to coordinate the rotation of machine room and outrigger structure, to perform the initial short vehicle lift before rotation and the outrigger hoist during rotation, and, to drive the cable winches to reel in and out the biplanes with a desired flight, the operator has available conventional override means to permit direct intervention during a malfunction or emergency.

Figure 6:
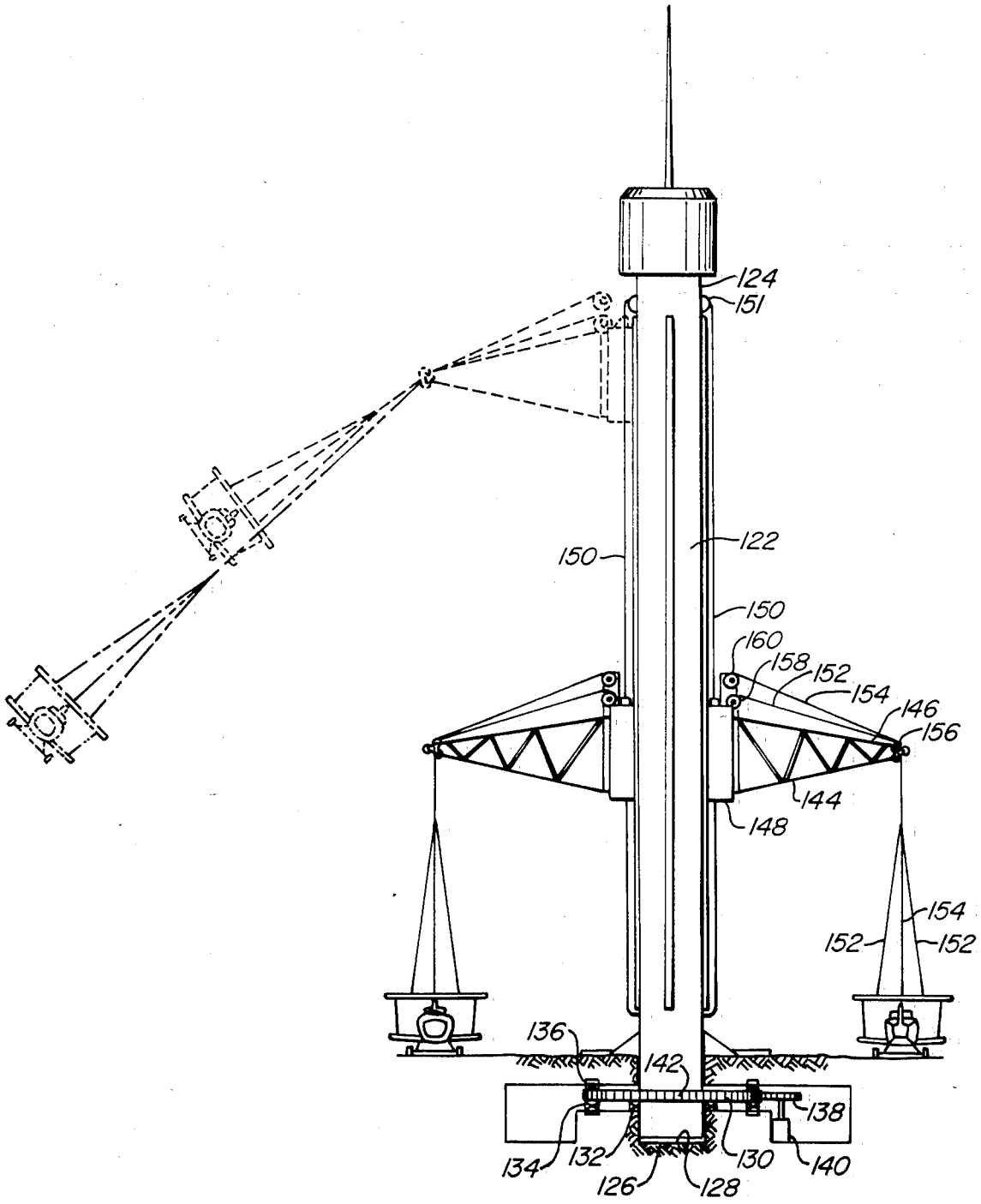
FIG. 6 is a front view of an alternate embodiment of the aerial amusement ride.

Referring now to FIG. 6, an alternate embodiment of the invention is shown. The aerial amusement ride 120 of the alternate embodiment is deisgned for smaller tower structures which can be rotated in their entirity. The alternate embodiment includes a tower 122 having a vertical column 124 positioned in a journal 126 set in a reinforced concret socket 128. Attached to the lower end of the column is a disc 130, for support of the column 124 on inner and outer bearings, 132 and 134. Outer top bearings 136 absorb any dynamic loads imparted to the column. The column is rotated by a drive gear 138 on a variable speed drive motor 140 which engages a gear 142 on the periphery of the disc 130.

The tower 122 includes an outrigger structure 144, with boom member 146 connected to a ring 148, which slides on guides 149 on the column 124. The ring 148 is connected to cables 150 which hoist the outrigger structure 144 to an elevated position shown in phantom. The cables 150 are directed over pulleys 151 at the top of the tower, and hoisted or lowered by a winch system as disclosed for the primary embodiment.

Biplanes are supported from cables, 152 and 154, which are guided around the end of the boom member 146 by a pulley unit 156. The cables are wrapped on winches, 158 and 160, which are independently operated to reel the biplanes in or out, as shown in phantom, and/or to raise or lower the nose of the biplane by select operation of the cable 152 connected to the nose of the biplane or the cable 154 connected to the tail of the biplane.

The biplanes are flown by the rotation of the entire tower, with altitude and flight simulation provided by the hoisting cables connected to the outrigger apparatus and the winch cables connected to the biplanes. By control of the independently operated components, a desired flight pattern can be obtained in a similar manner to that of the primary embodiment.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An aerial amusement ride comprising:

(a) a central tower;

(b) a plurality of passenger vehicles;

(c) an outrigger structure having coupling means for coupling said outrigger structure to said tower, wherein said outrigger structure is both rotatable about said tower and vertically displaceable on said tower, said outrigger structure having the same number of boom members as said plurlity of vehicles;

(d) first drive means on said tower for vertically displacing said outrigger structure on said tower;

(e) second drive means associated with said coupling means for rotating said outrigger structure about said tower concurrently with the raising and lowering of said outrigger structure;

(f) cable means having vehicle suspension cables connected to said vehicles for suspending said passenger vehicles and, (g) which means mounted on a support structure rotatably coupled to said tower for reeling said cables and displacing said suspended vehicles, wherein said outrigger structure has cable tracking means on the distal ends of said boom members over which said cables are guided, said winch support structure being rotated by third drive means on said tower in unison with said outrigger structure with the rotating and displacing of said outrigger structure being coordinated with reeling said vehicles in and out for a desired ride pattern.

2. The ride of claim 1 wherein said tower includes a vertically slidable ring and said outrigger structure includes a hub operably engaging said ring wherein said outrigger structure is rotatable about said tower on said ring said ring and hub comprising in part said coupling means.

3. The ride of claim 2 wherein said ring and hub have cooperating bearing means for rotation of said hub about said ring.

4. The ride of claim 2 wherein said second drive means includes a drive mechanism between said hub and ring wherein said hub is rotated about said ring on operation of said drive mechanism.

5. The ride of claim 2 wherein said cable tracking means includes pulley units and said winching means includes a plurality of independently operated winches, and, wherein said outrigger structure boom members with distal ends on which are mounted said pulley units, said vehicle cables being tracked from said winches on said rotatable support structure and over said pulley units for connection to said vehicles.

6. The ride of claim 5 wherein said vehicle cables have a separate cable connected to a fore portion and an aft portion of said vehicle, each cable being connected to a separate winch for independent control of the reeling of the fore and aft portions of said vehicle.

7. The ride of claim 6 wherein said pulley, units at the distal end of each boom member includes a first pulley assembly for a vehicle cable connected to the fore portion of one vehicle and a second pulley assembly connected to the aft portion of the next adjacent vehicle.

8. The ride of claim 2 wherein said ring slidably engages said tower, said tower having structural means for allowing vertically sliding and preventing rotation of said ring on said tower.

9. The ride of claim 8 wherein said structural means includes vertical guides on said tower slidably engaging said ring and hoist cables connected to said first drive means and to said ring.

10. The ride of claim 9 wherein said first drive means includes winch apparatus on said tower connected to said hoist cables for vertically displacing said ring and outrigger structure.

11. The ride of claim 1 wherein said vehicle cables have a separate cable connected to a fore portion and an aft portion of said vehicle, said winch means including a separate drive mechanism connected to each cable for independent reeling of the fore portion and the aft portion of said vehicles for simulated takeoff and landing.

12. The ride of claim 1 wherein said first, second and third drive means and said winch means include control means for coordinated operation of said ride in accordance with a control program.

* * * * *